US007058981B2

(12) United States Patent
Clark et al.

(10) Patent No.: US 7,058,981 B2
(45) Date of Patent: Jun. 13, 2006

(54) APPAREL AND ATTACHMENT SYSTEM THEREFOR

(75) Inventors: Erika H. Clark, Cody, WY (US); Lee Dexheimer, Portland, OR (US)

(73) Assignee: Bonfire Snowboarding Inc., Portland, OR (US)

( * ) Notice: Subject to any disclaimer, the term of this patent is extended or adjusted under 35 U.S.C. 154(b) by 380 days.

(21) Appl. No.: 10/352,192

(22) Filed: Jan. 28, 2003

(65) Prior Publication Data

US 2004/0143880 A1 Jul. 29, 2004

(51) Int. Cl.
*A41D 13/00* (2006.01)

(52) U.S. Cl. ..... 2/69

(58) Field of Classification Search ..... 2/455, 2/456, 16, 125, 126, 69, 96, 81, 84, 85, 93, 2/94, 115, 44, 410, 129, 6.2, 422, 247, 249
See application file for complete search history.

(56) References Cited

U.S. PATENT DOCUMENTS

| | | | | |
|---|---|---|---|---|
| 879,282 A | | 2/1908 | Mandeville | |
| 2,241,841 A | * | 5/1941 | Beckwith | 2/96 |
| 3,263,292 A | * | 8/1966 | Fekete | 24/595.1 |
| 5,815,833 A | * | 10/1998 | Kuo | 2/69.5 |
| 5,918,314 A | * | 7/1999 | Moses | 2/79 |
| 6,263,509 B1 | * | 7/2001 | Bowen | 2/69 |
| 6,370,692 B1 | * | 4/2002 | Duyn et al. | 2/86 |

FOREIGN PATENT DOCUMENTS

| | | |
|---|---|---|
| FR | 2 215 907 | 8/1974 |
| GB | 475396 | 11/1937 |
| GB | 524480 | 8/1940 |
| GB | 708324 | 5/1954 |
| GB | 944583 | 12/1963 |
| GB | 971859 | 10/1964 |
| GB | 2 398 833 B | 8/2005 |

* cited by examiner

*Primary Examiner*—Tejash Patel
(74) *Attorney, Agent, or Firm*—Greenblum & Bernstein, P.L.C.

(57) ABSTRACT

A connecting arrangement for apparel for such as sportswear, casual wear, technical wear and the like, as well as the apparel equipped with such arrangement. The connecting arrangement for apparel includes a first item of apparel including first connecting members and an item of apparel including second connecting members, the second connecting members being complementary to the first connecting members to allow a removable connection of the article of apparel to the first apparel item, the first and second connecting members providing a sliding male/female type connection.

35 Claims, 6 Drawing Sheets

Fig: 6a
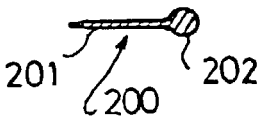
Fig: 7a
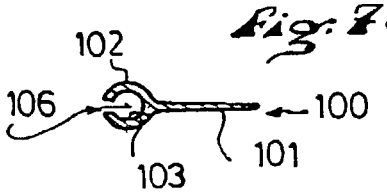
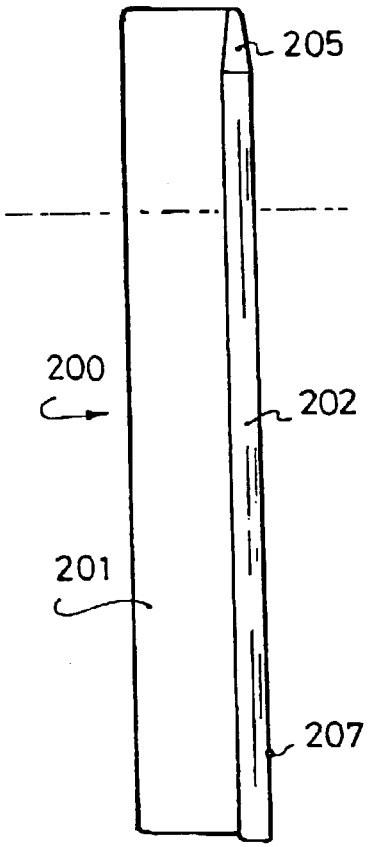
Fig: 6
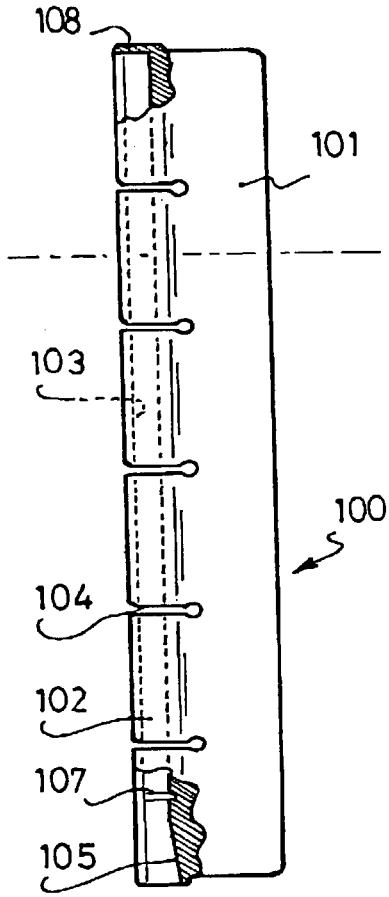
Fig: 7
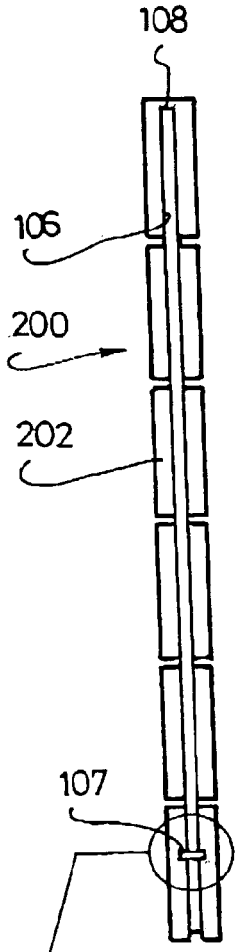
Fig: 8
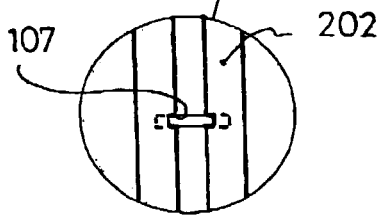
Fig: 9

APPAREL AND ATTACHMENT SYSTEM THEREFOR

BACKGROUND OF THE INVENTION

1. Field of the Invention

The present invention relates to a connecting arrangement for apparel such as sportswear, casual wear, technical wear and the like.

The invention is particularly suitable for attaching a first apparel item, or an accessory such as a hood, a pocket, a tool, or storage device or the like, to a particular article of apparel, such as a jacket, pants, etc.

2. Description of Background and Relevant Information

Jackets, especially winter or waterproof jackets, often have a hood to protect the head of the user when atmospheric conditions become difficult or severe, such as during the onset of snow, rain, and/or particularly strong winds.

However, when the atmospheric conditions improve and the user no longer needs protection for the head, he/she might desire that the head protection be removed.

Thus, hoods are often mounted in a removable manner.

A commonly used solution consists in providing the rear bottom of the hood with connecting elements, such as buttons, snaps, or a sliding zipper, which cooperates with appropriate complementary connecting elements of the jacket.

Such a connection, however, is not sufficient to provide a good waterproof or windproof connection in the front part of the jacket.

Indeed, when atmospheric conditions are severe, it is important to have a connection which is as closed as possible around the neck of the user, also in the front area.

Therefore, other attachment means, such as snaps or hook and loop attachment means, such as Velcro attachments, e.g., are often added at the front part of the hood to provide attachment with an associated collar part of the jackets.

In order to improve the aesthetic aspect of such a connection, some pockets are commonly provided on the collar part of the jacket to hide the attachment means. However, such pockets can render the attachment means difficult to use.

SUMMARY OF THE INVENTION

The present invention achieves an efficient and simple connecting arrangement between a first apparel item and an article of apparel or an accessory.

Further, the invention includes a connecting arrangement which can be adapted to various types of clothing and particularly which can be used to removably affix an apparel item, such as a hood, a pocket, accessory etc., to an article of apparel, such as a jacket, a pant, etc.

Still further, the present invention provides for a removable connecting arrangement which is aesthetically appealing.

Therefore, the invention encompasses a connecting arrangement for article of apparel, including a first apparel item, comprising first connecting members and an article of apparel comprising second connecting members, the second connecting members being complementary to the first connecting members to allow a removable connection of the article of apparel to the first apparel item, the first and second connecting members providing a sliding male/female type connection.

In a particular embodiment, the connecting arrangement includes a sleeve member with a longitudinal slit, and a rod member that is slidably coupled to the sleeve member for attaching the connecting arrangement together.

Such connecting arrangement is easy to use and is aesthetically appealing.

BRIEF DESCRIPTION OF DRAWINGS

The general nature of the invention having been described above, reference will be now made to the accompanying drawings, showing by way of an illustration, particular embodiments thereof and in which:

FIG. 6 is an elevation view of the male part of the connecting arrangement;

FIG. 6A is a transverse cross-sectional view of FIG. 6;

FIG. 7 is an elevation view of the female part of the connecting arrangement;

FIG. 7A is a transverse cross-sectional view of FIG. 7;

FIG. 8 is an elevation view of both connecting parts after assembly;

FIG. 9 is a detailed view of FIG. 8;

DETAILED DESCRIPTION OF THE INVENTION

Figure 1:
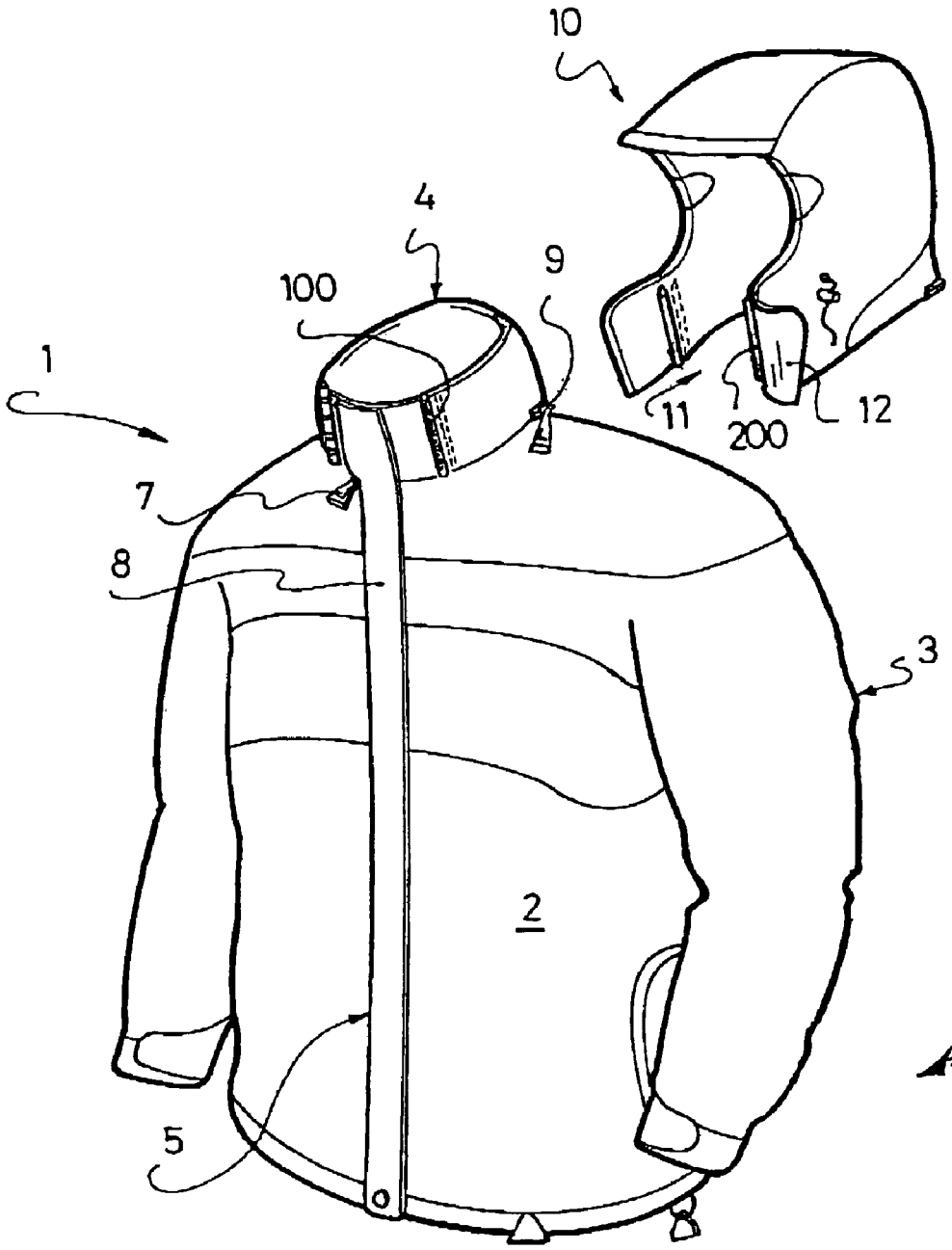
FIG. 1 is a front perspective view of a jacket and a hood provided with a connecting arrangement according to the invention.

FIG. 1 shows a first article of apparel or garment, such as a sport jacket, winter jacket, or windbreaker 1, and a hood 10, which is constructed so as to be removably connected to the jacket 1.

The jacket 1 includes a body 2 with sleeves 3 and a collar 4 extending vertically from the top end of the jacket to protect the neck of the user.

The collar 4 has a common longitudinal front opening 5 with the jacket, which is closed by a zipper 7, the zipper 7 being hidden by a flap 8.

On each side of the opening 5 and flap 8, the collar 4 includes a first connecting member 100.

The hood 10 includes a frontal opening 11 which is partially closed in the bottom by front flaps 12.

Each flap 12 is provided on its internal side with a second connecting member 200.

The base 101 can be affixed, for example by stitching, to the collar 4 of the jacket. In that way, the base 101 can be regarded as an attachment part for the first connecting member 100.

Furthermore, a connection by means of a zipper 9 is provided in a manner known per se, between the hood 10 and the jacket 1 at the rear thereof.

Figure 5:
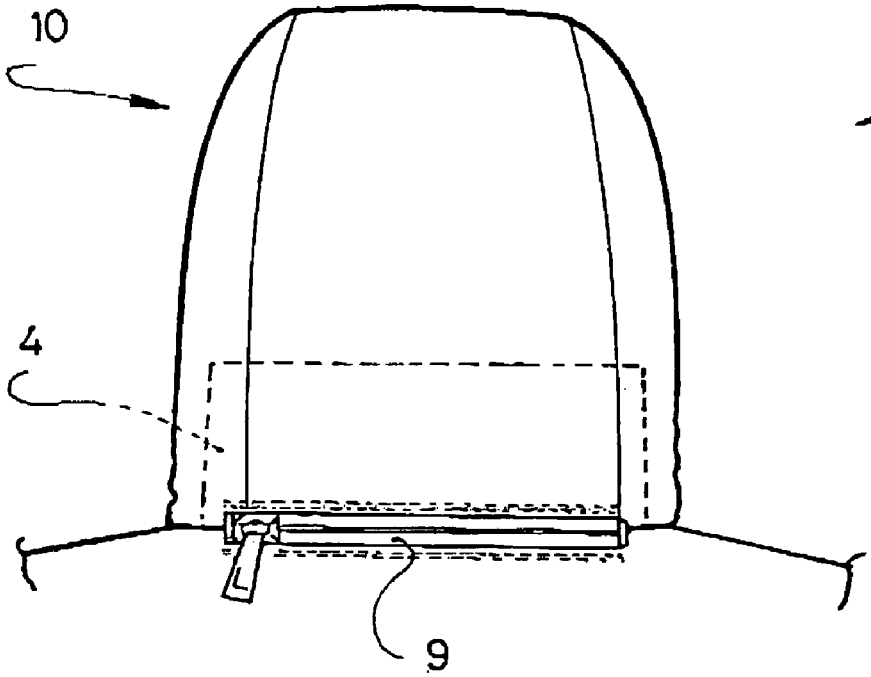
FIG. 5 is a rear view of FIG. 4, once the connection process is completed.

Such a connection by zipper 9 is depicted more specifically in FIG. 5.

First and second connecting members 100, 200 are depicted in detail on FIGS. 6–9.

First connecting member 100 includes a substantially flat rectangular base 101 with a longitudinal female receiving member or sleeve 102, directly attached thereto for receiving an associated rod member 202 of the second connecting member 200.

The base 201 can be affixed by stitching, for example, to the flaps 12 of the hood 10. In that way, the base 201 can be reaarded as an attachment part for the second connecting member 200.

As shown in FIG. 7A, the sleeve 102 is provided on the side opposed to the flat base 102 with a longitudinal slit 106 to allow the sleeve 102 to slide with respect to the rod 202.

Internally, the sleeve 102 includes a substantially cylindrical housing 103 having a diameter slightly greater than the diameter of the rod 102 to allow housing of the rod 102 within the sleeve 102, and the longitudinal slit 106 opens within such a housing 103.

Transverse flexibility cuts 104 are provided, preferably regularly, along the entirety of the length of the sleeve 102, or at least substantially along the entirety of the sleeve, to provide the sleeve with a certain flexibility.

With this construction, it is guaranteed that the sleeve 102 will not impart too much rigidity to the collar to which it is attached.

Depending upon the particular material(s) used for the sleeve, or the need for flexibility, such cuts 104 can be omitted.

In a particular embodiment, the sleeve 102 is made of a material such as TPU (thermoplastic polyurethane) and, again in a particular non-limiting embodiment, of a material having a greater rigidity than that of the rod. Depending upon the desired ease of release, the materials of the male and female parts may be of similar or the same rigidity.

As shown also in FIG. 7, the top of the housing 103 is closed by a wall 108, while the bottom thereof shows a truncated conical entry part 105 to facilitate entry of the rod part 202.

In another construction (not shown), the top part of the female end is open and the rod part protrudes through the opening in the top and thus also secures the two pieces by preventing one piece from being pulled away from the other one.

A slight indent 107 or peripheral groove is also provided at the bottom of the housing 103 in the embodiment illustrated.

Second connecting member 200 also includes a substantially flat rectangular base 201 and a longitudinal rod 202 attached thereto.

First and second connecting members, respectively 100, 200, cooperate together to allow a removable connection of the front flaps 12 of the hood with the front part of the collar. As can be seen in FIG. 1. for example, the connecting members upwardly, or substantially vertically, along the collar.

As previously indicated, the rod 202 has a substantially cylindrical shape with a diameter slightly smaller than that of the housing 103.

The top end of the rod 202 has a conical shape 205 to facilitate its entry in the associated conical entry part 105 of the sleeve 102.

A projecting part 207 is also provided at the bottom of the rod 202 to cooperate with the groove 107 at the sleeve 102 and to indicate the completion of the connecting phase by a snap effect.

The role of the projecting part 207 and groove 107, or snap elements 107, 207, is also to avoid an unwanted disassembly of both connecting members 100, 200. The projecting part and groove part may be placed in other areas of the assembly.

The rod 202 is made of a softer material than that of the sleeve part, in a particular embodiment, and, for example, the rod can be made from TPU (thermoplastic polyurethane) of a lesser hardness. According to a non-limiting example, the TPU of the male part 202 has a durometer hardness of Shore A 75, while the female part 101 has a durometer hardness of Shore A 90. The invention encompasses hardnesses of different values, as well as different materials.

Figure 2:
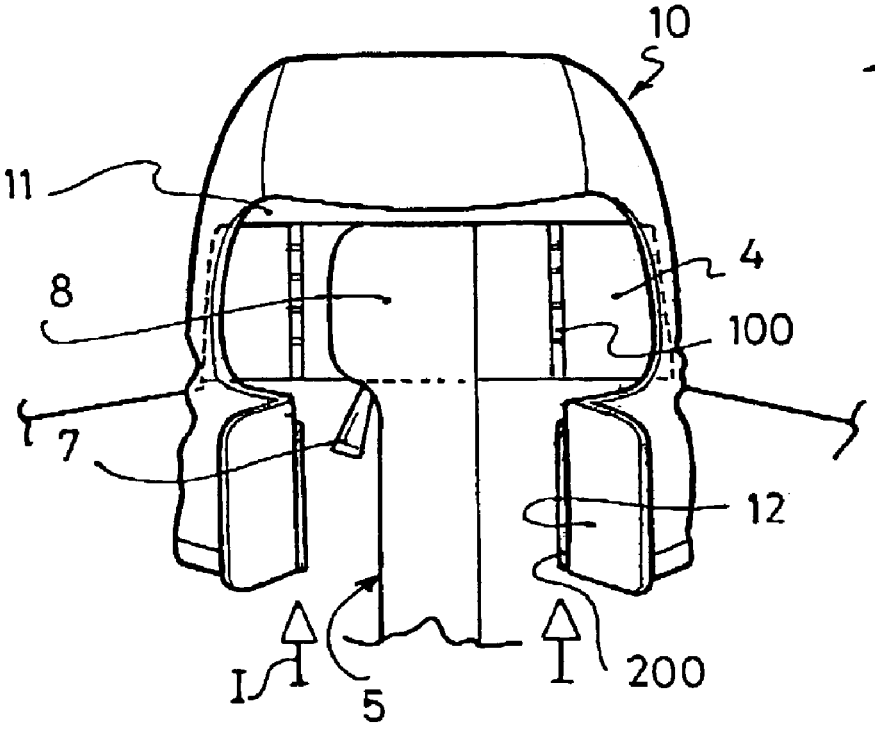
FIG. 2 is a partial front view showing a first step of a connection process between the jacket and the hood.
Figure 3:
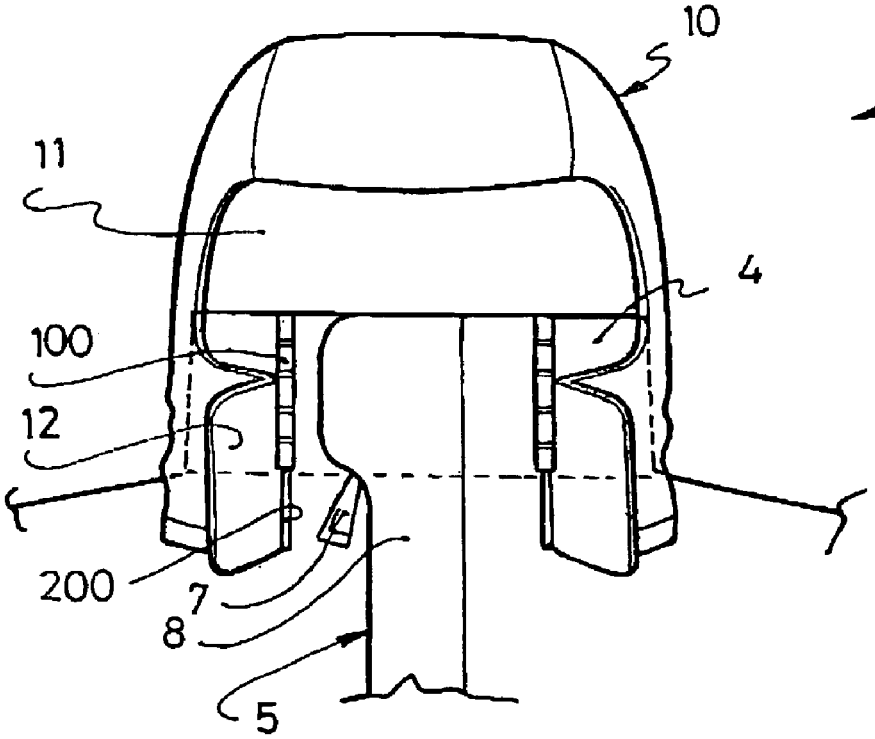
FIG. 3 is a similar view to FIG. 2, showing a second step of the connection process.
Figure 4:
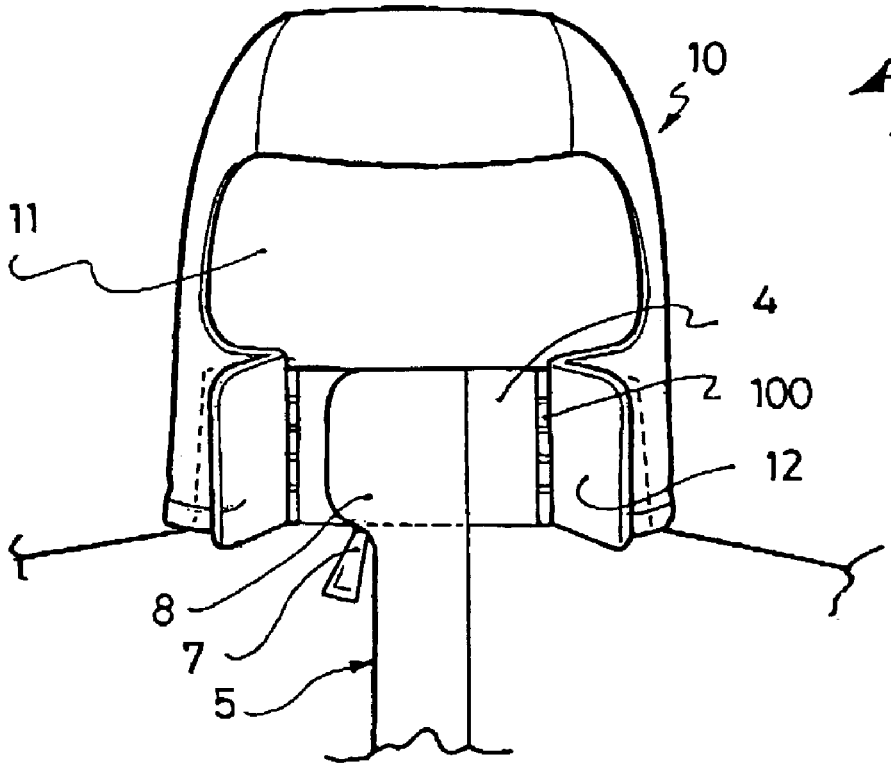
FIG. 4 is a view similar to FIGS. 2 and 3, showing a final step of the connection process.

Various steps of the assembly phase of connecting the hood 10 to the jacket are depicted in FIGS. 2 to 4.

Once the hood 10 and the jacket are assembled at the rear via the zipper 9, both rod parts 202 are introduced from the bottom (see arrows 1 in FIG. 2) in each associated sleeve part 102 in an ascending movement, the connecting phase being completed when the snapping of the projecting part 207 occurs in an associated groove 107.

It will be appreciated that the positions of the sleeve 102 and rod 202 may be switched.

Similarly, materials can also be switched or chosen differently.

Rod 202 and sleeve 102 can also have different cross-sectional shapes, such as rectangular, square, triangular, or otherwise.

An advantage of a circular cross-section is to allow a mutual rotation once the connecting members are assembled. However, different cross-sectional shapes could provide additional security from the male and female parts pulling apart.

Figure 10:
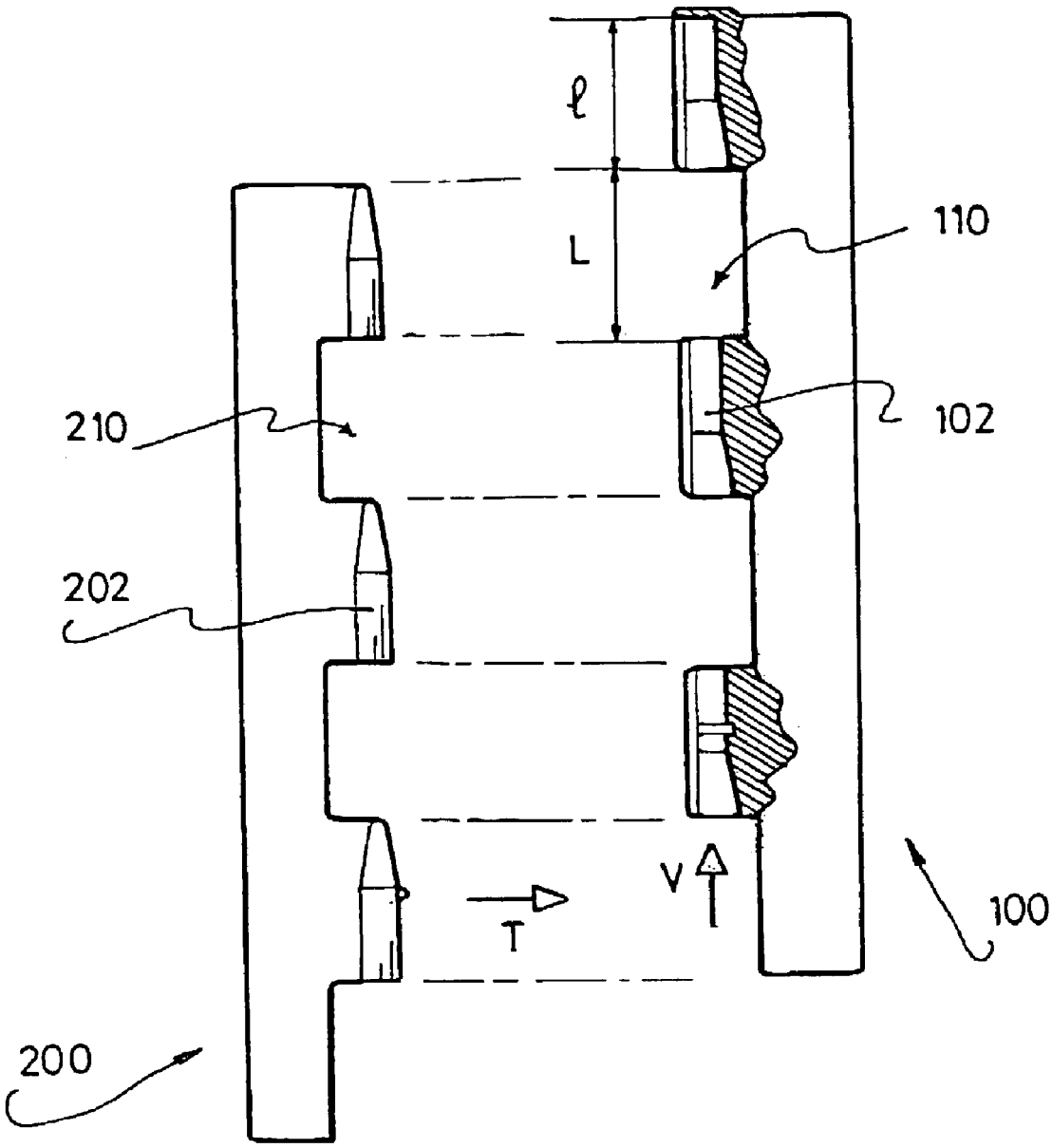
FIG. 10 is an elevation view of male and female parts according to a second embodiment.

FIG. 10 depicts a second embodiment of the rod and sleeve in which similar elements will be referred to by the same reference numerals.

A primary difference between this second embodiment and the previously described embodiment is that each connecting member 100, 200, respectively, has portions of sleeve member 102, rod member 202 of a given length l, and the successive rod and sleeve portions 202, 102, respectively, are separated by open areas 210, 110, respectively, having a length L greater than the length l of the rod and sleeve portions.

With such a construction, the introduction movement of the rod members in the sleeve members is effected first by a translation movement T for introducing each rod member 202 in an associated open area 110 of the sleeve and then a vertical sliding movement V of each rod member 202 within a sleeve member 102.

With such a construction the introduction is easier as it requires less space (only the length L).

Figure 11:
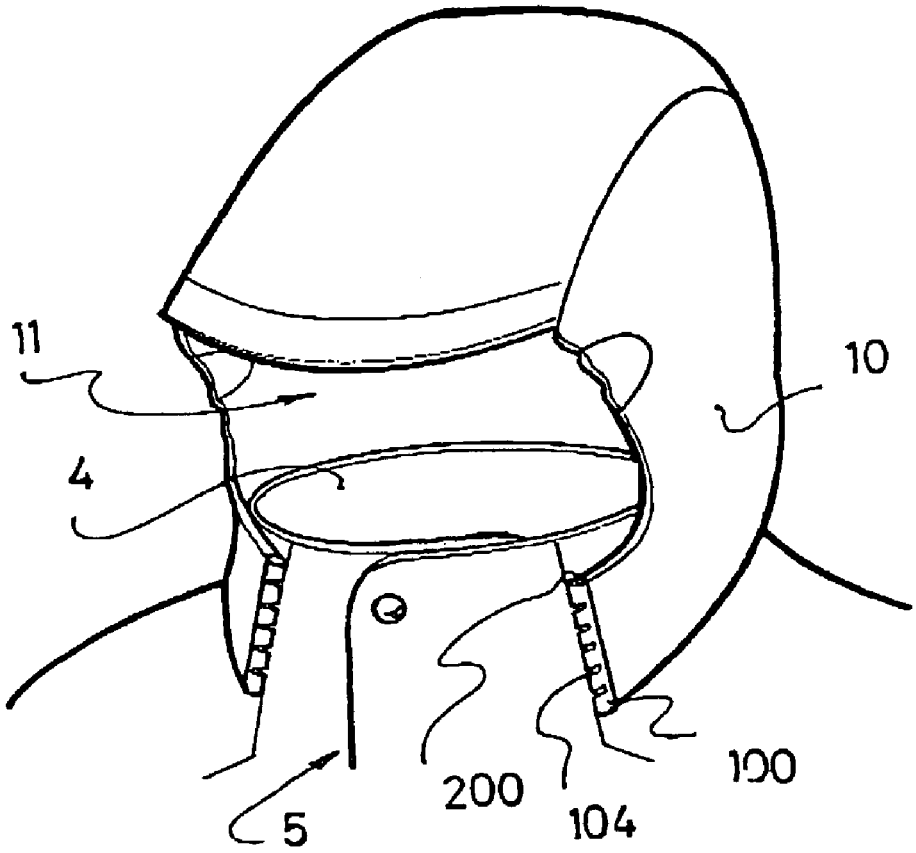
FIG. 11 is a front perspective view of a jacket/hood connecting arrangement according to a third embodiment.

FIG. 11 depicts a third embodiment in which similar elements will be referred to by the same reference numerals.

The embodiment of FIG. 11 is substantially the same as that depicted in FIG. 1. A difference is that the hood 10 is devoid of front flaps 12.

In such an embodiment, both the first and second connecting members 100, 200 are visible from the outside.

In such a case, both first and second connecting members 100, 200 are dyed in a color matching the color of the hood and the jacket, for example in the same color or in a contrasting color.

In such a case, a very aesthetic and/or technological appearance can be achieved.

While the above invention has been described with reference to certain particular embodiments, it should be kept in mind that the scope of the present invention is not limited to these particular embodiments.

For example, the materials and fasteners can be used on other garments, shoes, articles, bags, and the like. The embodiments described above can also be modified so that some features of one embodiment are used with the features of another embodiment. It is intended that the appended claims cover all such modifications and embodiments as fall within the true spirit and scope of the present invention.

What is claimed is:

1. A connecting arrangement for an article of apparel that includes a first item and a second item, said connecting arrangement comprising:

a first connecting member of said first item of said article of apparel;

a second connecting member of said second item of said article of apparel;

said first and second connecting members having complementary shapes to allow removable connection of said second item to said first item said complementary shapes providing a male/female type of connection, said male/female type connection comprising:

at least one longitudinally extending sleeve providing a longitudinally extending housing, said sleeve further including a longitudinal slit through a thickness of said sleeve to communicate with said longitudinal housing of said sleeve;

at least one longitudinal rod adapted to be selectively slidably coupled within, and slidably uncoupled from, said longitudinal housing of said sleeve;

said first and second connecting members comprising complementary truncated conical introduction parts to facilitate entry of said longitudinal rod into said longitudinal housing of said sleeve.

2. A connecting arrangement according to claim 1, wherein:

said first and second connecting members comprise complementary snap elements, said snap elements being engaged at completion of coupling of said rod and said sleeve.

3. A connecting arrangement according to claim 1, wherein:

said sleeve is made of a material more rigid than a material of said rod.

4. A connecting arrangement according to claim 1, where in:

said rod is made of a material more rigid than a material of said sleeve.

5. A connecting arrangement according to claim 1, wherein:

each of said first and second connecting member is made of thermoplastic polyurethane.

6. A connecting arrangement according to claim 1, wherein:

at least said rod has a durometer hardness of Shore A 75.

7. A connecting arrangement according to claim 1, wherein:

at least said sleeve has a durometer hardness of shore A 90.

8. A connecting arrangement according to claim 1, wherein:

each of said first and second connecting member comprises an attachment part for attachment to the first and second items, respectively.

9. A connecting arrangement according to claim 1, wherein:

at least one of the first and second connecting members comprises flexibility cuts.

10. A connecting arrangement according to claim 1, wherein:

the rod and the sleeve have circular cross sections.

11. A connecting arrangement according to claim 1, wherein:

the first item of said article of apparel is a jacket and the second item of said article of apparel is a hood.

12. A connecting arrangement according to claim 1, wherein:

the first item of said article of apparel is a jacket and the second item of said article of apparel is a pocket.

13. A connecting arrangement according to claim 1, wherein:

the first item of said article of apparel is a pant and the second item of said article is a pocket.

14. A connecting arrangement according to claim 1, wherein:

both the longitudinal sleeve and the longitudinal rod extend substantially vertically when coupled.

15. A connecting arrangement according to claim 11, wherein:

both the longitudinal sleeve and the longitudinal rod are adapted to extend substantially vertically along a wearers neck when the rod and sleeve are coupled to connect the hood to the jacket.

16. A connecting arragement for an article of apparel that includes a first item and a second item, said connecting arragement comprising:

a first connecting member of said first item of said article of apparel;

a second connecting member of said second item of said article of apparel;

said first and second connecting members having complementary shapes to allow removable connection of said second item to said first item;

said complementary shapes providing a male/female type of connection, said male/female type connection comprising:

at least one longitudinally extending sleeve providing a longitudinally extending housing, said sleeve further including a longitudinal slit through a thickness of said sleeve to communicate with said longitudinal housing of said sleeve;

at least one longitudinal rod adapted to be selectively slidably coupled within, and slidably uncoupled from, said longitudinal housing of said sleeve;

the sleeve and the rod have different values of hardness and/or are made of different materials.

17. A connecting arrangement according to claim 16, wherein:

said first and second connecting members comprise complementary snap elements, said snap elements being engaged at completion coupling of said rod and said sleeve.

18. A connecting arrangement according to claim 16, wherein:

said sleeve is made of a material more rigid than a material of said rod.

19. A connecting arrangement according to claim 16, wherein:

said rod is made of a material more rigid than a material of said sleeve.

20. A connecting arrangement according to claim 16, wherein:

each of said first and second connecting members is made of thermoplastic polyurethane.

21. A connecting arragement according to claim 16, wherein:

at least said rod has a durometer hardness of Shore A 75.

22. A connecting arrangement according to claim 16, wherein;

at least said sleeve has a durometer hardness of shore A 90.

23. A connecting arrangement according to claim 16, wherein:

each of said first and second connecting member comprises an attachment part for attachment to the first and second items, respectively.

24. A connecting arrangement according to claim 16, wherein:

at least one of the first and second connecting members comprises flexibility cuts.

25. A connecting arrangement according to claim 16, wherein: the rod and the sleeve have circular cross sections.

26. A connecting arrangement according to claim 16, wherein:

the first item of said article of apparel is a jacket and the second item of said article of apparel is a hood.

27. A connecting arrangement according to claim 16, wherein:

the first item of said article of apparel is a jacket and the second item of said article of apparel is a pocket.

28. A connecting arrangement according to claim 16, wherein:

the first item of said article of apparel is a pant and the second item of said article of apparel is a pocket.

29. A connecting arrangement according to claim 16, wherein:

both the longitudinal sleeve and the longitudinal rod extend substantially vertically when coupled.

30. A connecting arrangement according to claim 26, wherein:

both the longitudinal sleeve and the longitudinal rod are adapted to extend substantially vertically along a wearer's neck when the rod and sleeve are coupled to connect the hood to the jacket.

31. A connecting arrangement for an article of apparel that includes a first item and a second item, said connecting arrangement comprising:

a first connecting member of said first item of said article of apparel;

a second connecting member of said second item said article of apparel;

said first and second connecting members having complementary shapes to allow removable connection of said second item to said first item said complementary shapes providing a male/female type of connection, said male/female type connection comprising:

at least one longitudinally extending sleeve providing a longitudinally extending housing, said sleeve further including a longitudinal slit Through a thickness of said sleeve to communicate with said longitudinal housing of said sleeve;

at least one longitudinal rod adapted to be selectively slidably coupled to, and slidably uncoupled from within, said longitudinal housing of said sleeve;

the longitudinal housing of said slate extends upwardly to a top opening, the rod protruding through the top opening, thereby increasing security of the coupling of the rod and the sleeve from being pulled apart.

32. A connecting arrangement according to claim 31, wherein:

said rod and the housing of said sleeve have circular cross sections, said cross section of the housing of said sleeve being greater than said cross section of said rod when said rod is coupled to said sleeve.

33. An article of apparel comprising:

a jacket, said jacket comprising a body, sleeves, and a collar, said collar extending upwardly from the jacket to protect a wearer's neck;

a hood removably connected to the collar of the jacket; and a connecting arrangement for connecting the hood to the jacket said connecting arrangement comprising:

a first connecting member of secured to the collar of the jacket a second connecting member secured to the hood;

said first and second connecting members having complementary shapes to allow removable connection of said second item to said first item;

said complementary shapes providing a male/female type connection, said male/female type connection comprising:

at least one longitudinal sleeve providing a longitudinal housing, said sleeve further including a longitudinal slit through a thickness of said sleeve to communicate with said longitudinal housing of said sleeve;

at least one longitudinal rod adapted to be selectively slidably coupled within, and slidably uncoupled from said longitudinal housing of said sleeve;

the sleeve and the rod extending longitudinally upwardly along the collar of the jacket when coupled and when the article of apparel is worn.

34. An article of apparel according to claim 33, wherein:

the sleeve and the rod have circular cross sections, enabling mutual rotation when the sleeve and the rod are coupled.

35. An article of apparel according to claim 34, wherein:

said jacket comprises a front opening, said first connecting member being secured to one side of the front opening, another first connecting member being secured to a second side of the front opening;

said hood comprises an opening for the wearer's face:

below said face opening, said hood is fitted with a pair of second connecting members for coupling with respective ones of said first connecting members.

* * * * *